US010356506B2

(12) United States Patent
Kang et al.

(10) Patent No.: US 10,356,506 B2
(45) Date of Patent: Jul. 16, 2019

(54) PORTABLE SOUND EQUIPMENT

(71) Applicant: LG ELECTRONICS INC., Seoul (KR)

(72) Inventors: Kwancheol Kang, Seoul (KR); Siyoung Park, Seoul (KR); Junsoo Park, Seoul (KR); Wonjae Kang, Seoul (KR); Hyunsun Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/840,745

(22) Filed: Dec. 13, 2017

(65) Prior Publication Data

US 2018/0184186 A1 Jun. 28, 2018

(30) Foreign Application Priority Data

Dec. 26, 2016 (KR) ..... 10-2016-0179179

(51) Int. Cl.

| | |
|---|---|
| ***H04R 1/02*** | (2006.01) |
| ***H04R 1/10*** | (2006.01) |
| ***F21V 33/00*** | (2006.01) |
| ***F21V 5/00*** | (2018.01) |

(52) U.S. Cl.

CPC ..... *H04R 1/105* (2013.01); *F21V 5/002* (2013.01); *F21V 33/0056* (2013.01); *H04R 1/1016* (2013.01); *H04R 1/1025* (2013.01); *H04R 1/1041* (2013.01); *H04R 2420/07* (2013.01)

(58) Field of Classification Search

CPC .... H04R 1/105; H04R 1/1025; H04R 1/1033; H04R 1/1066; H04R 1/1016

See application file for complete search history.

(56) References Cited

U.S. PATENT DOCUMENTS

2016/0073200 A1* 3/2016 Yoo ..... H04R 5/0335 381/311

2016/0366506 A1 12/2016 Kim

FOREIGN PATENT DOCUMENTS

| | | | |
|---|---|---|---|
| JP | 8-212874 | A | 8/1996 |
| JP | 2012-230998 | A | 11/2012 |
| KR | 10-1365926 | B1 | 2/2014 |
| KR | 10-2014-0044553 | A | 4/2014 |
| KR | 10-2016-0147687 | A | 12/2016 |

* cited by examiner

*Primary Examiner* — Amir H Etesam

(74) *Attorney, Agent, or Firm* — Birch, Stewart, Kolasch & Birch, LLP

(57) ABSTRACT

A portable sound equipment comprising a neckband wire configured to wrap a predetermined region of a user's neck, a main body coupled to both ends of the neckband wire and configured to form an electric control unit, a first button hole configured to form an open portion in the main body; a first button exposed outside via the first buttonhole, a side case configured to cover a first area of the main body which includes the first button hole, and a drainage groove provide in the first area along a circumference of the first button hole and forming a step with an outer surface of the main body is provided, so as to enhance the waterproof structure and realize the slim design and light weight.

7 Claims, 14 Drawing Sheets

(a)

(b)

(c)

PORTABLE SOUND EQUIPMENT

Pursuant to 35 U.S.C. § 119(a), this application claims the benefit of earlier filing date and right of priority to Korean Application No. 10-2016-0179179, filed on Dec. 26, 2016, the contents of which are hereby incorporated by reference herein in their entirety.

BACKGROUND OF THE DISCLOSURE

Field of the Disclosure

Embodiments of the present disclosure relates to a portable sound equipment which may transceive an audio signal with a terminal by wire or wireless communication and transmit a control signal for controlling the terminal based on a signal input via a user input unit.

Discussion of the Related Art

Sound equipment means a sound device for receiving a sound signal from a terminal and transmitting sound information collected through a microphone to the terminal. According to the related art, portable sound equipment has employed a wired mechanism for receiving a sound signal by inserting a terminal in an ear jack of a terminal. Yet, in aspects of mobility and use convenience, the demand for wireless communication type portable sound equipment is increasing recently.

Various types of portable sound equipment configured to be portable on user's body (e.g., a headphone type in shape of a band fit to a head, an ear-hung type, an ear-fit type, etc.) are being developed in consideration of portability.

Recently, there are increasing demands for a neckband type portable sound equipment which is wearable on a user's neck. Unless using the neck-band type portable sound equipment, the user is able to keep an earbud in the neck-band type portable sound equipment. The load of the neck-band type sound equipment is applied to the user's shoulder or collarbone, not the ears or head, so that the user can feel less heavy.

Accordingly, the neck-band type portable sound equipment is able to hold quite a weight to a preset degree and then enlarge the capacity of the battery to a specific level.

However, the neck-band type portable sound equipment still requires a small size and a light weight, only to have disadvantages of heat generation and durability.

Moreover, it is necessary to enhance a waterproof function as the wearable terminal which is worn on the user's body part.

SUMMARY OF THE DISCLOSURE

An object of the present disclosure is to solve and enhance the waterproof function and realize the slim body which is the disadvantage of the conventional portable sound equipment.

To achieve these objects and other advantages and in accordance with the purpose of the disclosure, as embodied and broadly described herein, a portable sound equipment comprises a neckband wire configured to wrap a predetermined region of a user's neck; a main body coupled to both ends of the neckband wire and configured to form an electric control unit; a first button hole configured to form an open portion in the main body; a first button exposed outside via the first buttonhole; a side case configured to cover a first area of the main body which includes the first button hole;

and a drainage groove provide in the first area along a circumference of the first button hole and forming a step with an outer surface of the main body.

The drainage groove may comprise an upper groove horizontally formed in an upper area of the first button hole; and a side groove vertically formed in both sides of the first button hole and continuously formed from both ends of the upper groove.

The portable sound equipment may further comprise a second button hole configured to form an open portion in the main body; and a second button provided in the second button hole, wherein the second button comprises a holding portion exposed outside via the second button hole; a hooking portion coupled to one end of the holding portion and supporting an inner wall of the electric control unit provided in the main body; and a sealing portion provided in a boundary circumference of the hooking portion and supporting a boundary inner wall of the second button hole.

The sealing portion may comprise Urethane and formed in the hooking portion by double injection molding.

In another aspect of the present disclosure, a portable sound equipment comprises a neckband wire configured to wrap a predetermined area of a user's neck; a main body coupled to both ends of the neckband wire and configured to form an electric control unit; and a fixing side wall configured to form an insert hole, in which an end of the neckband wire is inserted, in the main body, wherein an end of the neckband wire comprises a fixing bracket seated in the electric control unit of the main body; a recess forming a step with an outer surface of the fixing bracket and fixed to the fixing lateral wall; and a wire unit projected from one side of the fixing bracket, and the fixing side wall comprises a first support portion supporting the fixing bracket; and a second support portion supporting the wire unit and forming a step with the first support portion.

The main body may comprise a lower case; an upper case coupled to an upper end of the lower case and forming the electric control unit; a first fastening boss provided in the lower case and having an outer circumferential surface fastened to the fixing bracket; a second fastening boss provided in the upper case and fastened to the first fastening boss; and a rib provided in an inner surface of the upper case and connecting the first support portion and the second fastening boss with each other.

The portable sound equipment may further comprise a screw hole through which the first fastening boss and the second fastening boss pass; a screw fastened to the screw hole along a direction from a lower end to an upper end of the lower case; a hole cap configured to block a predetermined area of the screw hole having the screw exposed there through; and a pressure adjust hole formed through a space formed between the screw and the hole cap and the electric control unit.

In a further aspect of the present disclosure, a portable sound equipment comprises a neckband wire configured to wrap a predetermined region of a user's neck; a main body comprising a first body and a second body coupled to both ends of the neckband wire, respectively; a first electric control unit and a second electric control unit formed in the first body and the second body and comprising an upper portion, a lower portion and a middle portion having a wider cross sectional area in a longitudinal direction of the first or second body than the upper portion and the lower portion; a printed circuit board comprising a first printed circuit board and a second printed circuit board provided in center portions of the first and second electric control units, respectively; a first battery coupled to a rear surface of the first printed circuit board and narrower than the first printed circuit board, and a second battery coupled to a rear surface of the second printed circuit board and narrower than the second printed circuit board; and a first adhesive material disposed between the first battery and a lower surface of the first body, and a second adhesive material disposed between the second battery and a lower surface of the second body.

The portable sound equipment may further comprise a light emitting element provided in a rear surface of the printed circuit board; and a light emitting unit configured to be luminescent by diffusing the light emitted from the light emitting element, wherein the light emitting unit comprises a luminescent lens provided on the same phase with the printed circuit board and exposed to the exterior of the main body; a diffusion portion extended from the luminescent lens and located adjacent to the light emitting element; and an expanded portion extended from the diffusion portion and located in a lateral surface of the printed circuit board.

One end of the expanded portion may support one surface of the electric control unit provided in the main body and the other end of the expanded portion may support a lateral surface of the printed circuit board.

The effects of the wireless sound equipment according to the embodiments of the disclosure will be as follows.

According to at least one of the embodiments, the portable sound equipment is capable of strengthening the waterproof structure.

Furthermore, the portable sound equipment is capable of enhancing the durability.

Still further, the portable sound equipment is capable of realizing the waterproof structure, at small cost.

Still further, the portable sound equipment is capable of enhancing the coupling force between the neckband wire and the main body.

Still further, the portable sound equipment is capable of realizing a slim design.

Still further, the weight of the portable sound equipment is not focused on one side.

Still further, the screw of the portable sound equipment may not be noticeable when seen outside.

Still further, the hole cap of the portable sound equipment may not be separated easily.

It is to be understood that both the foregoing general description and the following detailed description are exemplary and explanatory and are intended to provide further explanation of the disclosed subject matter as claimed.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Sound equipment means a sound device for receiving a sound signal from a terminal and transmitting sound information collected through a microphone to the terminal. According to the related art, portable sound equipment has employed a wired mechanism for receiving a sound signal by inserting a terminal in an ear jack of a terminal. Yet, in aspects of mobility and use convenience, the demand for portable sound equipment's of wireless communication type is increasing recently.

Various types of portable sound equipment configured to be portable on user's body (e.g., a headphone type in shape of a band fit to a head, an ear-hung type, an ear-fit type, etc.) are being developed in consideration of portability.

Recently, there are increasing demands for a neckband type portable sound equipment which is wearable on a user's neck. Unless using the neck-band type portable sound equipment, the user is able to keep an earbud in the neck-band type portable sound equipment. The load of the neck-band type sound equipment is applied to the user's shoulder or collarbone, not the ears or head, so that the user can feel less heavy.

Accordingly, the neck-band type portable sound equipment is able to hold quite a weight to a preset degree and then enlarge the capacity of the battery to a specific level.

However, the neck-band type portable sound equipment still requires a small size and a light weight, only to have disadvantages of heat generation and durability.

Moreover, it is necessary to enhance a waterproof function as the wearable terminal which is worn on the user's body part.

Figure 1:
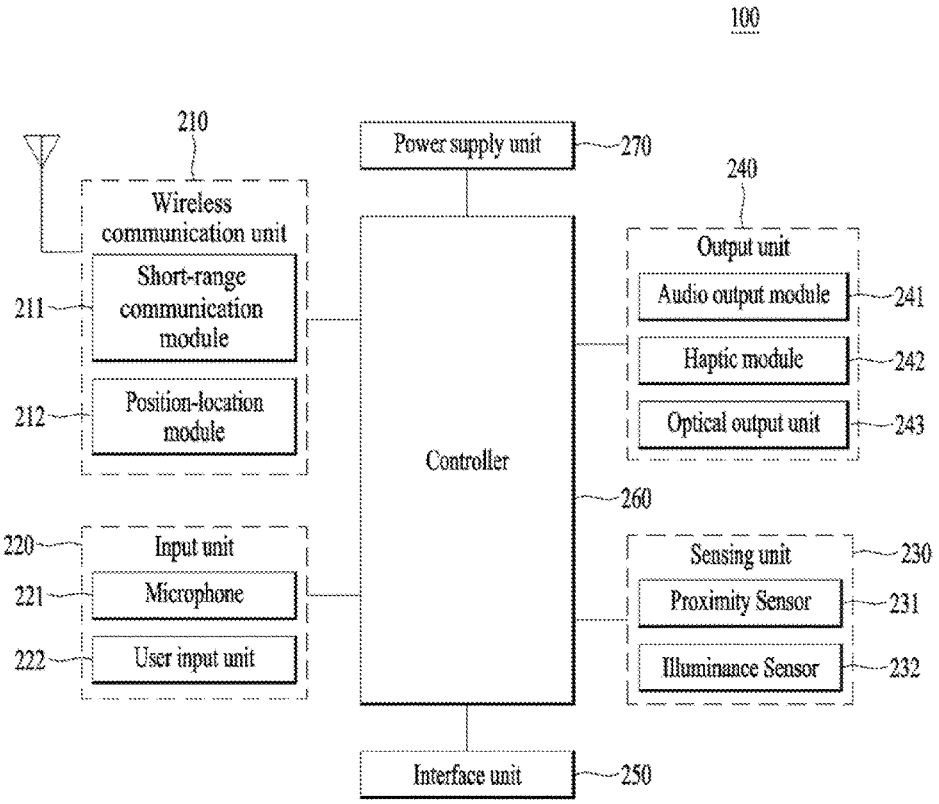
FIG. 1 is a block diagram illustrating a structure of a portable sound equipment according to one embodiment of the present disclosure.

FIG. 1 is a block diagram of a wireless sound equipment according to one embodiment of the disclosure.

The wireless sound equipment 100 includes a wireless communication unit 210, an input unit 220, a sensing unit 230, an output unit 240, an interface unit 250, a controller 260 and a power supply unit 270.

The elements shown in FIG. 1 are not necessary to realize the portable sound equipment. The portable sound equipment described in the specification may include more or less than the elements described above.

More specifically, the wireless communication unit 210 of the elements may include one or more modules which facilitates wireless communication between the portable sound equipment 100 and a wireless communication system, another mobile terminal or an external server. Also, the wireless communication unit 210 may include one or more modules for connecting the portable sound equipment 100 with one or more networks.

The wireless communication unit 210 may include at least one of a short range communication module 211 and a location information module 212. If necessary, it may further include a mobile communication module or a wireless internal module.

The short range communication module 211 is configured to facilitate short range communication and support the short range communication by using at least one of Bluetooth™, RFID (Radio Frequency Identification), IrDA (Infrared Data Association), UWB (Ultra Wideband), ZigBee, NFC (Near Field Communication), Wi-Fi (Wireless-Fidelity), Wi-Fi Direct and Wireless USB (Wireless Universal Serial Bus) techniques.

The short range communication module 211 may support wireless communication between the portable sound equipment 100 and a wireless communication system, another mobile terminal or a network in which another mobile terminal (or an external server) is located. The short range communication networks may be wireless personal area networks.

The short range communication module 211 may be configured to sense or recognize a communicable terminal which is located near the portable sound equipment 100. In case the sensed terminal is the one authenticated to communicate with the portable sound equipment 100, the controller 260 may receive some of the data processed in the mobile terminal through the short range communication module 211. Accordingly, the user of the portable sound equipment 100 is able to use the data processed in the terminal through the wearable device.

For example, when there is a call received in the terminal, the user is able to answer a call by using the portable sound equipment 100.

The location information module 212 is the module for acquiring the location or present location of the portable sound equipment 100. Typical examples of the location information module 212 include GPS (Global Positioning System) and WiFi (Wireless Fidelity). As one example, the mobile terminal using a GPS module is capable of acquiring the location of the portable sound equipment 100 based on a signal transmitted from a GPS satellite. As another example, the portable sound equipment 100 using WiFi is capable of acquiring the location of the portable sound equipment 100 based on information of AP (Wireless Access Point) configured to transceive a wireless signal with the Wi-Fi module. If necessary, the location information module 212 may additionally perform a function of another module provided in the wireless communication unit 110 to gain data about the location of the portable sound equipment 100. The location information module 215 is the module used in acquiring the location or present location of the portable sound equipment 100, not limited to the module for directly calculating or acquiring the location of the portable sound equipment 100.

The input unit 220 may include a microphone 221 an audio input unit for inputting an audio signal and a user input unit 222 for receiving input information from the user (for example, a touch key, a mechanical key and the like). The voice or image data collected in the input unit 220 is analyzed and processed into the user's control command.

The user input unit 222 is configured for the user to control the portable sound equipment 100. Examples of the user input unit 222 include a call button, a button for adjusting a volume, a power button and a storage button for storing an audio cable in a main body.

The user input unit 222 may include only the call button and the pair of the volume adjustment buttons or further include a play/stop button and a playlist change button rather than them.

The size of the portable sound equipment 100 is restricted and users are likely to perform inputs, not looking at the user input unit 222. If too many buttons are provided, it becomes difficult to distinguish each function of the buttons from each other. Accordingly, the time and frequency of button pressings and inputtable control commands may be expanded by using the limited number of the buttons and the combination of the buttons.

The microphone 221 processes an audio signal input from an external device into electric voice data. The processed voice data may be used based on the function performed in the portable sound equipment 100 (or the application program implemented in the portable sound equipment) or transmitted to the external terminal or server via the wireless communication unit 210. Various noise removal algorithms can be realized in the microphone to remove the noise generated while external audio signal is input.

The sensing unit 230 may include one or more sensors for sensing at least one of user information and peripheral information near the portable sound equipment. Examples of the sensing unit 230 may include one or more of a proximity sensor 231, an illumination sensor 232, a touch sensor, an acceleration sensor, a magnetic sensor, a G-sensor, a gyroscope sensor, a motion sensor, a RGB sensor, an IR sensor (Infrared sensor), a finger scan sensor, a ultrasonic sensor, an optical sensor, a microphone 221, a battery gauge, an environment sensor (e.g., a barometer, a hygroscope, a thermometer, a radiation detection sensor, a thermal sensor, a gas sensor and the like) and a chemical sensor (e.g., an electronic nose, a health care sensor, a biometric sensor and the like). Meanwhile, the portable sound equipment in accordance with the present disclosure may use combination of the information data sensed by at least two sensors.

Especially, the sensor unit 130 may include a sensor for sensing presence of an earphone at a holder and the magnetic sensor may be used as a typical example of such a sensor.

The output unit 240 is configured to generate outputs which are related with sight, heating and touch. The output unit 240 may include at least one of an audio output unit 241, a haptic module 242 and an optical output unit 243.

The audio output unit 241 is a device configured to output sounds based on an audio signal. Examples of the audio output unit 241 include an earphone configured to be inserted in the user's ears and transmit sounds and a speaker configured to output sounds while the user is not wearing the earphone.

The interface unit 250 functions as a passage to diverse types of external devices which are connected with the portable sound equipment 100. The interface unit 250 may include at least one of an external charger port and a wired/wireless data port. The portable equipment 100 may perform a proper control which is related with the connected external device(s), corresponding to the external device(s) connected with the interface unit 250.

The controller 260 is implemented to control overall operations of the portable sound equipment 100 as well as operations which are related with the application programs. The controller 260 may process signal, data information the input or output via the elements mentioned above.

Under the control of the controller 260, the power supply unit 270 is configured to supply the external electric power and internal power applied thereto to each of the elements provided in the portable equipment 100. The power supply unit 270 includes a battery and the battery may be an internal battery or exchangeable battery.

A predetermined number of the elements may be cooperative to realize control and execution or a control method of the portable sound equipment in accordance with diverse embodiments which will be described hereinafter.

Figure 2:
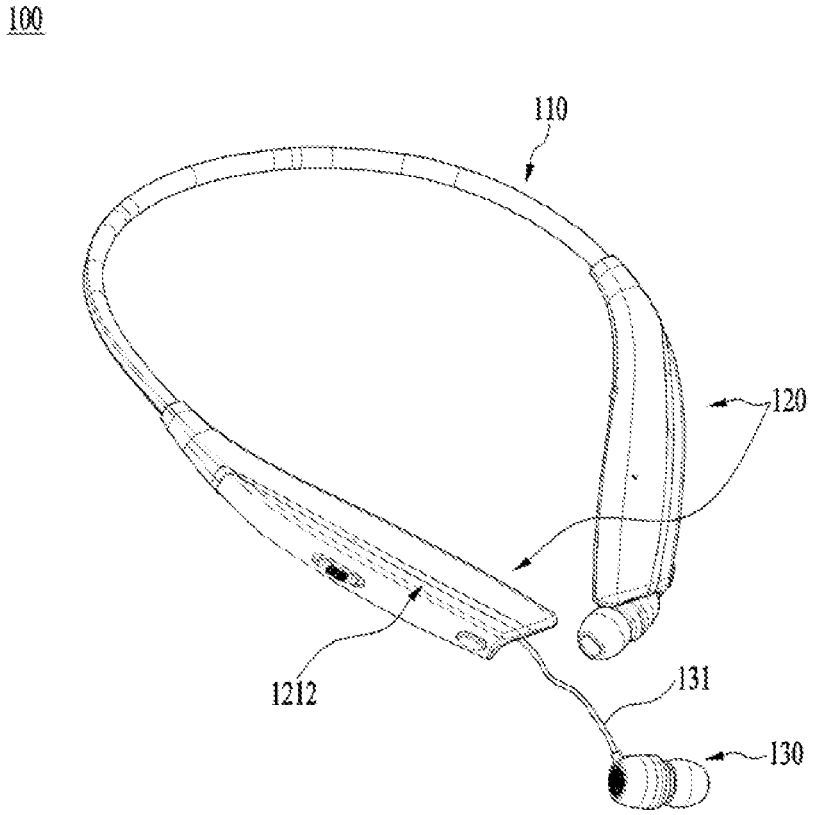
FIG. 2 is a front perspective diagram illustrating the portable sound equipment.

FIG. 2 is a front perspective view illustrating the portable sound equipment 100.

The portable sound equipment 100 may simply include a neck-band wire 110 and a main body 120 and an ear unit 130.

For easy and convenient explanation sake, the direction in which the user wearing the portable sound equipment 100 see the ground is defined as a downward direction and the reverse direction is defined as an upward direction. The direction of the user's front view is defined as a forward direction and the reserve direction is defined as a rearward direction and a right-and-left direction is defined as a lateral or horizontal direction.

The neckband wire 110 is configured to wrap around a predetermined area of the user's neck. The main body 120 is coupled to both ends of the neckband wire 110. The overall appearance of the neckband wire 110, the main body 120 and the ear unit 130 may look like a bilateral symmetry.

The coupling between neckband wire 110 and the main body 120 has one open side to dispose the portable sound equipment 100 on the user's neck stably.

The neckband wire 110 has a restoring force to widen and narrow the portable sound equipment 100 so as to allow it to be worn on the user's neck.

Each of two main bodies 120 may have a hollow portion to define an electric control unit. Electronic components of the portable sound equipment 100 are loaded in the electric control unit.

The electronic components may include key components such as a battery, a printed circuit board and the like.

The ear unit 130 has a drive unit loaded therein and the drive unit is configured to directly output sounds. The ear unit 130 may be electrically connected with the electronic components of the main body 120 via an ear unit wire 131.

The ear unit wire 131 is pulled out from the main body 120 when the user uses the ear unit 130 and pushed into the main body when not using the ear unit 130. The ear unit 130 may be detached from a seating portion of the main body 120 to be worn on the user's ear in use and seated in the seating portion to be kept and maintained.

Figure 3:
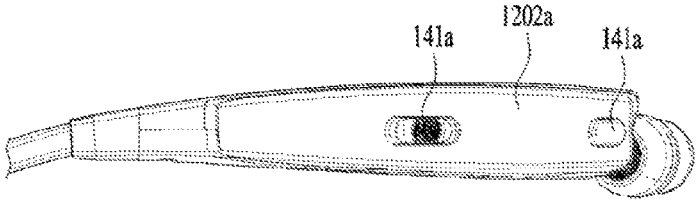
FIG. 3 is a diagram illustrating an outer surface and an inner surface of the portable sound equipment.
Figure 3:
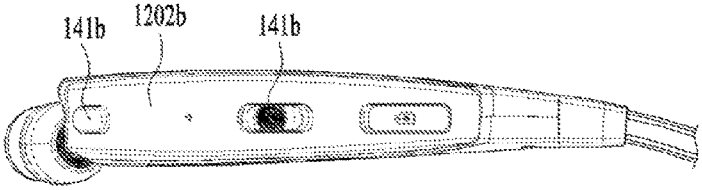
Figure 3:
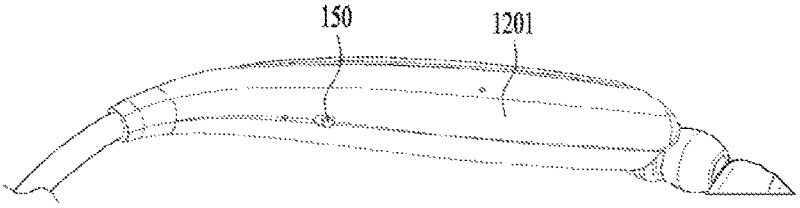

FIG. 3 is a diagram illustrating an outer surface and an inner surface of the portable sound equipment 100.

A button is provided in the main body 120 to receive the user's input. Especially, the button may be provided in an outer surface 1202 or an inner surface 1201 of the main body 120, which is one of examples. As occasion occurs, it may be provided in an upper surface 1203 or a lower surface 1204.

In FIG. 3, (a) and (b) illustrate two outer surfaces 1202*a* and 1202*b* of the main body 120 and (c) illustrates one inner surface of the main body 120. The button provided in the outer surface 1202 is defined as an outer button and the button provided in the inner surface 1201 is defined as the inner button.

The buttons may function as the user input unit for receiving the user's input to the user interface.

The button may include a power button for power ON/OFF; a button for playing/stopping music or receiving a call; a button for controlling the volume; and a button for selecting a music playlist.

Alternatively, the button may be a wire-winding button for pulling the unit wire 131, which electrically connects the ear unit 130 and the main body 120 with each other, into the main body 120.

The outer button may be configured to perform a more frequently used function and the inner button may be configured to perform a less frequently used function. For example, the power button which is less frequently used may be provided as the inner button.

Examples of the button may include a dome key which is pressible physically, a toggle key which is slide type and a touch key which senses touch based on variation of capacitance.

Figure 4:
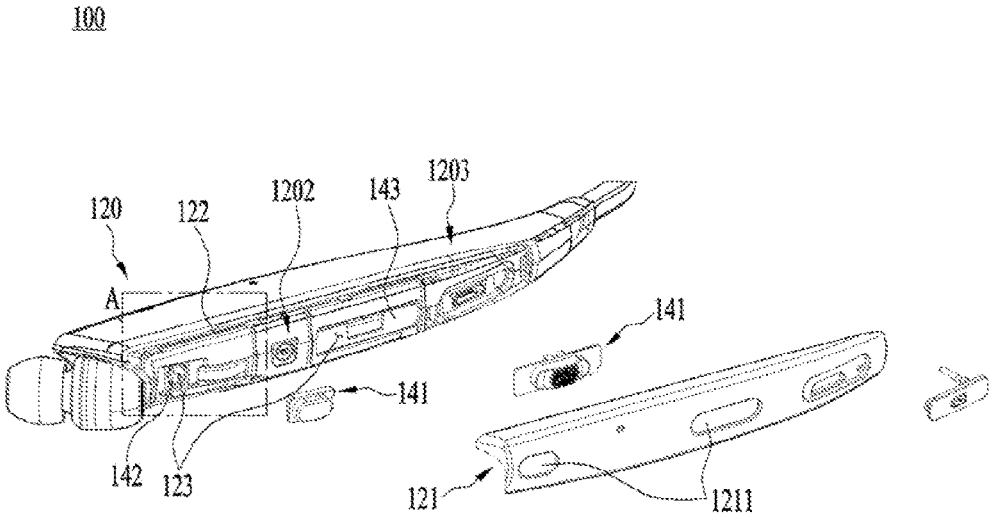
FIG. 4 is an exploded perspective diagram partially illustrating the portable sound equipment.
Figure 5:
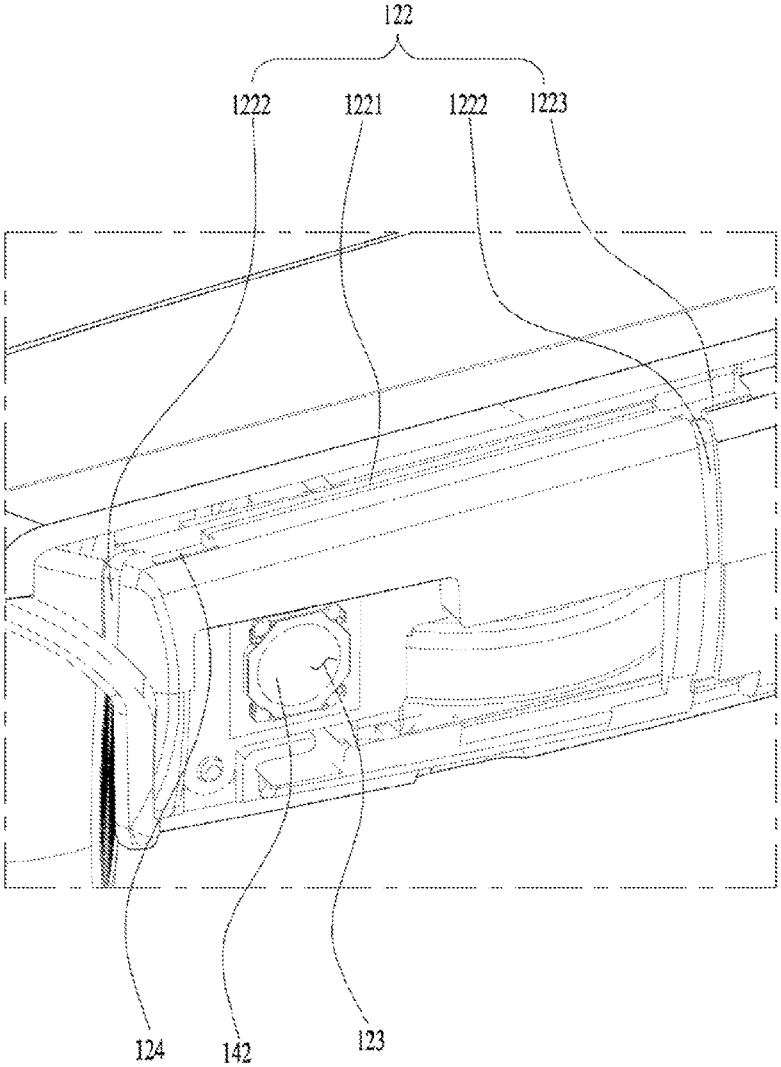
FIG. 5 is an enlarged view of "A" shown in FIG. 4.

FIG. 4 is an exploded perspective diagram partially illustrating the portable sound equipment 100 and FIG. 5 is an enlarged view of "A" shown in FIG. 4. For easy explanation, FIGS. 4 and 5 will be referred to.

The main body 120 may include at least one first button hole 123 for the first button 141. The first button 141 may be expose outside the main body 120 through the first button hole 123. The button and the button hole to which a drainage groove as an unique characteristic is applied may be defined as the first button 141 and the first button hole 123.

In the illustrated embodiment, the first button hole 123 and the first button 141 are provided in the outer surface 1202 of the main body 120. The characteristics of the present disclosure are not limited to the button provided in the outer surface 1202 and may be applied to any button provided in the inner surface 1201 or the upper surface 1203.

The first button hole 123 may form an open portion in the main body 120. The first button hole 123 is configured to connect the outside and the inside of the main body 120 with each other. In other words, the first button hole 123 is configured to electrically connect the first button 141 provided outside the main body 120 with the dome key 142 or slider 143 and even the printed circuit board which are provided inside the main body 120.

The first button 141 is configured to be directly pressed by the user. As the first button 141 is pressed, the dome key generates an electrical signal and the generated electrical signal is transmitted to the printed circuit board. The components may be added or reduced according to the type of the button. For example, the toggle button includes a slider 143, not the dome key 142.

A side case 121 may surround a first area of the main body 120 and the first area of the main body 120 may include an area where the first button hole 123 is provided.

The side case 121 may include an opening 1211 for exposing a pressed surface of the first button 141. The size of the opening formed in the side case 121 is corresponding to that of the pressed surface provided in the first button 141, so that the first button 141 may not be separated through the opening 1211, even without any auxiliary fixing structure.

In addition, the side case 121 is employed to cover the nonsmooth exterior or the components not needed to be exposed. The side case 121 covers a boundary between the first button hole 123 or upper case 1207 and the lower case 1208 not to be exposed outside.

Moreover, the side case 121 may be configured to prevent the exposure of the drainage groove 122 which will be described later.

The first area of the main body 120 covered by the side case 121 may be a lateral area 1202. Together with that, the side case 121 may be extended to some area of the upper surface 1203 or lower surface 1204 of the main body to cover the area of the upper surface 1203 or lower surface 1204 of the main body 120.

When the side case 121 covers even the predetermined area of the upper or lower surface 1203 or 1204 of the main body, the coupling structure between the side case 121 and the main body can be simply realized. In other words, a hook groove 124 is formed in the upper surface 1203 and the lower surface 1204. A hook is formed in a corresponding point of the side case 121 to the hook groove 124.

The side case 121 couples to some areas of the upper surface 1203 and the lower surface 1204 provided in the main body 120, so that the coupling between the upper case 1207 and the lower case 1208 of the main body 120 may be kept more stably.

The structure of the first button 141 mentioned above inevitably causes a waterproof problem because of the first button hole 123. In other words, external liquid is at risk for flowing into the electric control unit via the first button hole 123. Even when the side case 121 is coupled to the first area of the main body 120, the boundary between the two members is not sealed with an auxiliary waterproof material so that the liquid might flow through a gap (1212, see FIG. 2) formed between the side case 121 and the main body 120. The liquid permeated through the gap (1212, see FIG. 2) might flow into the first button hole 123 even the electric control unit 1205 of the main body 120.

The drainage groove 122 is configured to prevent such external liquid from flowing into the first button hole 123. The drainage groove 122 forms a water flow passage to facilitate the flow of the permeated liquid toward one point of the drainage groove 122 to re-flow outside along the drainage groove 122.

The drainage groove 122 may be formed along a circumference of the first button hole 123. It may form a looped curve along all-direction circumference of the first button hole 123. Alternatively, a lower portion of the first button 141 may form an open curve with an open bottom. The permeated liquid is likely to fall down from above like rain drops or sweat, so that the liquid permeating downward while the user is actually using the portable sound equipment 100 might be often a problem. Accordingly, the drainage groove 122 may be configured to surround upper, right and left portions of the first button hole 123.

One drainage groove 122 located in an upper portion may be defined by an upper groove 1221 and the other ones located in right and left portions may be defined as the side grooves 1222. The upper groove 1221 may be horizontally formed beyond the first button hole 123. The side grooves 1222 may be continuously provided from right and left ends of the upper groove 1221. The side grooves 1222 may be vertically provided with respect to the upper groove 1221.

The drainage groove 122 may include a collecting groove 1223 which is formed in at least one corner thereof and is larger than the remainder of the drainage groove 122 in the width or depth. The collecting groove 1223 is configured to minimize the water overflowing toward the first button hole 123 from the drainage groove 122, when the amount of the permeated liquid is large.

A hook groove 124 may be provided in the drainage groove 122 and occupies a predetermined area of the drainage groove 122 to function not only to facilitate the hook coupling to the hook and as the drainage groove simultaneously.

The drainage groove 122 may be covered by the side case 121. In other words, the drainage groove 122 may be formed in the first area.

The drainage groove 122 may be as large as possible within the first area. The large drainage groove 122 is configured to increase the possibility of liquid inflow and the amount of the liquid which can be collected in the drainage groove 122. Accordingly, the drainage groove 122 may be formed even to some upper area as well as lateral surface. In other words, an upper groove 1221 of the drainage groove 122 may be provided in the upper surface 1203 of the main body 120.

In case the plurality of the first button holes 123 are provided, the plurality of the drainage grooves 122 may be provided corresponding to the plurality of the first button holes 123, respectively. Alternatively, the drainage groove 122 may be provided as one looped curve surrounding the plurality of the first button holes 123.

The first button 141 may be applied regardless of the dome key type or the slide toggle button type. In this instance, the waterproof structure realized by the drainage groove 122 may be more applicable in case the first button 141 is the dome key type. More specifically, when the first button 141 is the dome key type which is pressible vertically, a gap is inevitably generated by the pressing and a sealing type waterproof structure, which will be described later, is likely to fail in realizing the complete waterproof. Accordingly, the drainage groove 122 type configured to shut off the liquid inflow to the first button 141 and peripheral portions of the first button hole 123 may be more advantageous.

Figure 6:
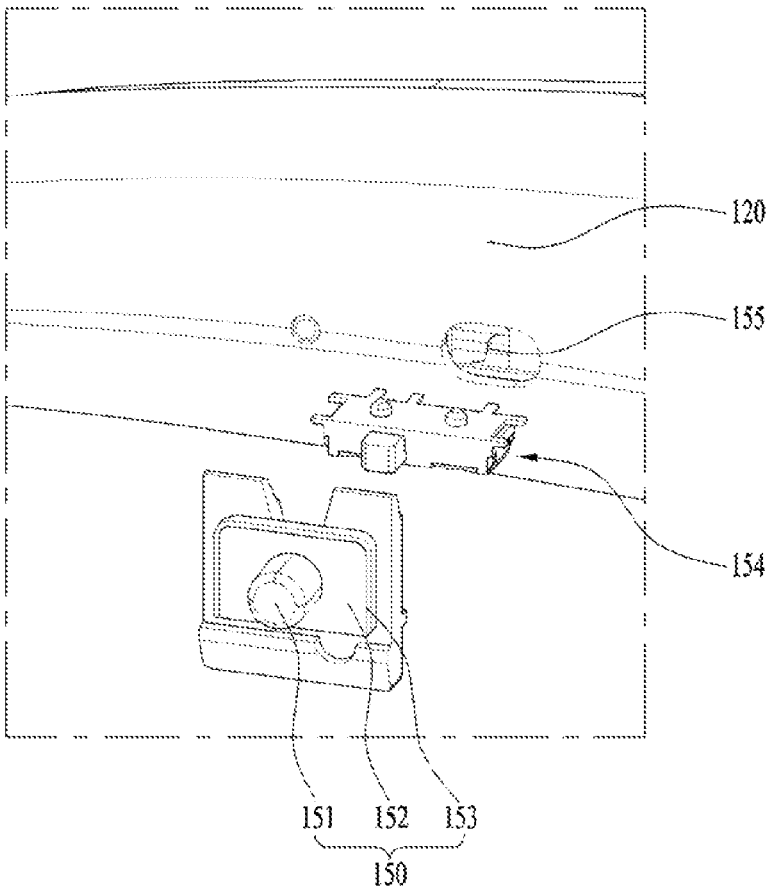
FIG. 6 a diagram partially illustrating the portable sound equipment.
Figure 7:
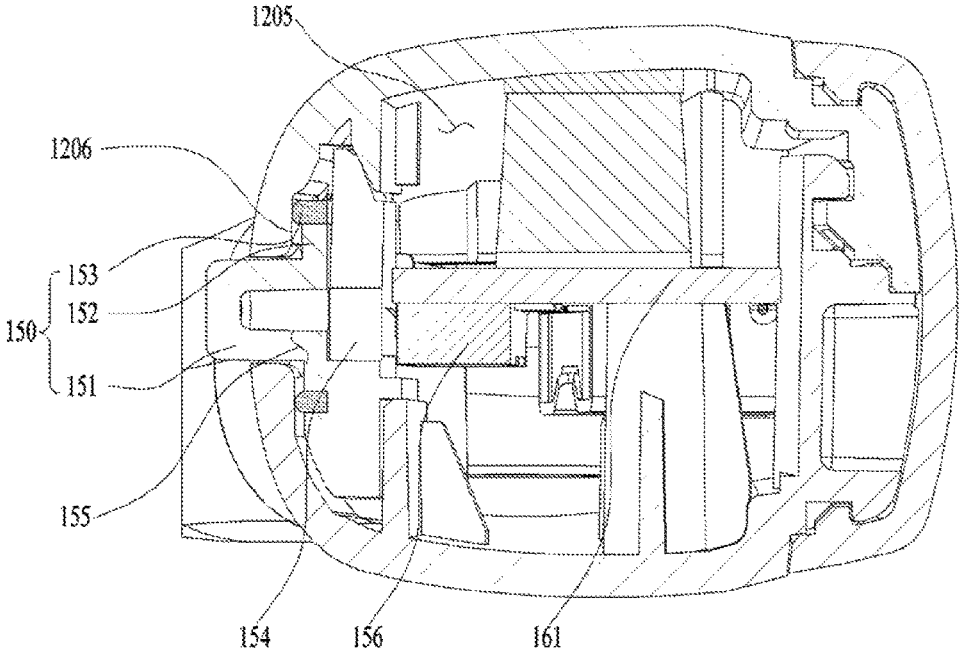
FIG. 7 is a sectional diagram illustrating a main body having an area in which a second button is provided.

FIG. 6 a diagram partially illustrating the portable sound equipment 100 and FIG. 7 is a sectional diagram illustrating the main body 120 having an area in which a second button 150 is provided. For easy explanation sake, FIGS. 6 and 7 will be referred to together.

FIGS. 4 and 5 illustrate the embodiment of the waterproof structure about the button hole provided in the area where the side case 121 is provided. Even though the drainage groove 122 is formed in the area where the side case 121 is provided, the drainage groove may be covered by the side case 121 and the exterior design may not be affected. However, if the button is provided in the area where the side case 121 is not provided, there is a problem caused in the waterproof structure.

Hereinafter, one embodiment will be described which shows the structure of the button configured to realize waterproof by using a sealing unit. The button to which the illustrated embodiment is applied may be defined as a second button 150. FIG. 6 shows that the second button 150 is provided in an inner surface 1201 of the main body 120. However, it is obvious that the second button 150 may be provided in other areas.

The second button hole 155 for the second button 150 may form an open portion in the main body 120. A predetermined area of the second button 150 may be exposed outside via the second button hole 155.

Like the first button 141 mentioned above, the second button 150 may be also provided in the form of a dome key type or a slide type toggle button. The illustrated embodiment shows that the second button 150 is the toggle button.

In case it is provided as the slide key type toggle button, the second button 150 is coupled to the slider 154 and the slider 154 is fastened to a switch loaded in the printed circuit board provided in the electric control unit of the main body 120 to transmit the drive of the second button 150 to the switch.

The second button 150 includes a holding portion 151, a hooking portion 152 and a sealing portion 153. The holding portion 151 is exposed outside via the second button 155, so that the user may press or slide the holding portion 151 to perform the user's input.

The hooking portion 152 is coupled to one end of the holding portion 151 and located in the electric control unit of the main body 120. The hooking portion 152 is employed to support an internal wall of the electric control unit 1205 provided in the main body 120 to prevent the second button 150 loaded in the electric control unit from separating outside via the second button hole 155.

The slider 154 is coupled to an inner surface of the hooking portion 152 and configured to transmit the movement of the second button 150 to the switch. A recessed area may be provided in an inner surface of the hooking portion 152 to be coupled to the slider 154.

The sealing portion 153 is provided in a circumference of the hooking portion 152 and configured to support a boundary wall of the second button hole 155. The sealing portion 153 is configured to seal the gap generated between the hooking portion 152 and the inner wall 1206 of the electric control unit 1205 provided in the main body 120 so as to block the inflow of the liquid.

For the sealing effect, the sealing portion 153 may include an elastic material, for example, urethane. The sealing portion 153 may be double injection molded. When seeing the second button 150 in front, the sealing portion 153 may form the looped curve to completely block the possibility of the liquid inflow.

The waterproof structure realized by the sealing portion 153 may be applicable in case the second button 150 is the dome key type or slide key toggle button. However, it may be more advantageous structurally when the second button 150 is the toggle button type. Different from the dome key type second button, the toggle button type second button keeps the state of supporting the inner wall 1206 of the electric control unit 1205 so that the supporting effect of the sealing portion 153 can be kept and maintained.

Figure 8:
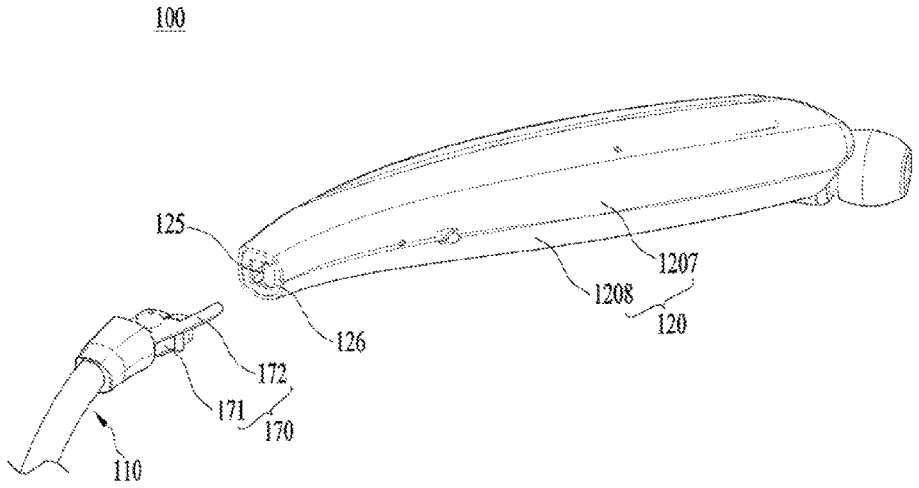
FIG. 8 is an exploded perspective diagram partially illustrating the portable sound equipment.
Figure 9:
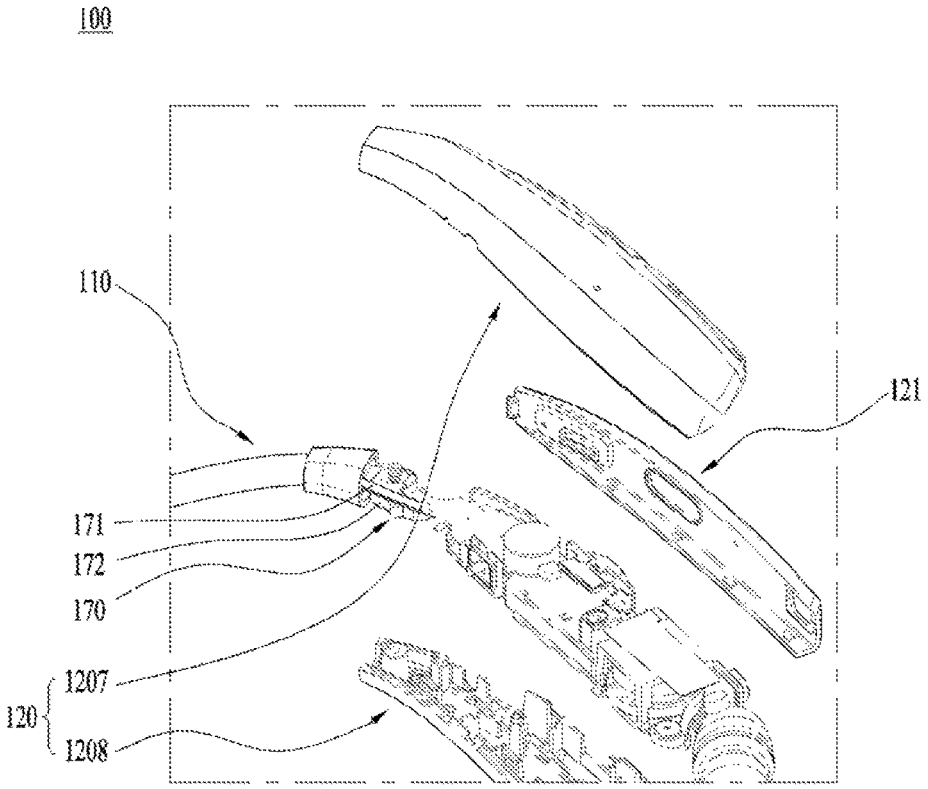
FIG. 9 is an exploded perspective diagram partially illustrating the portable sound equipment.
Figure 10:
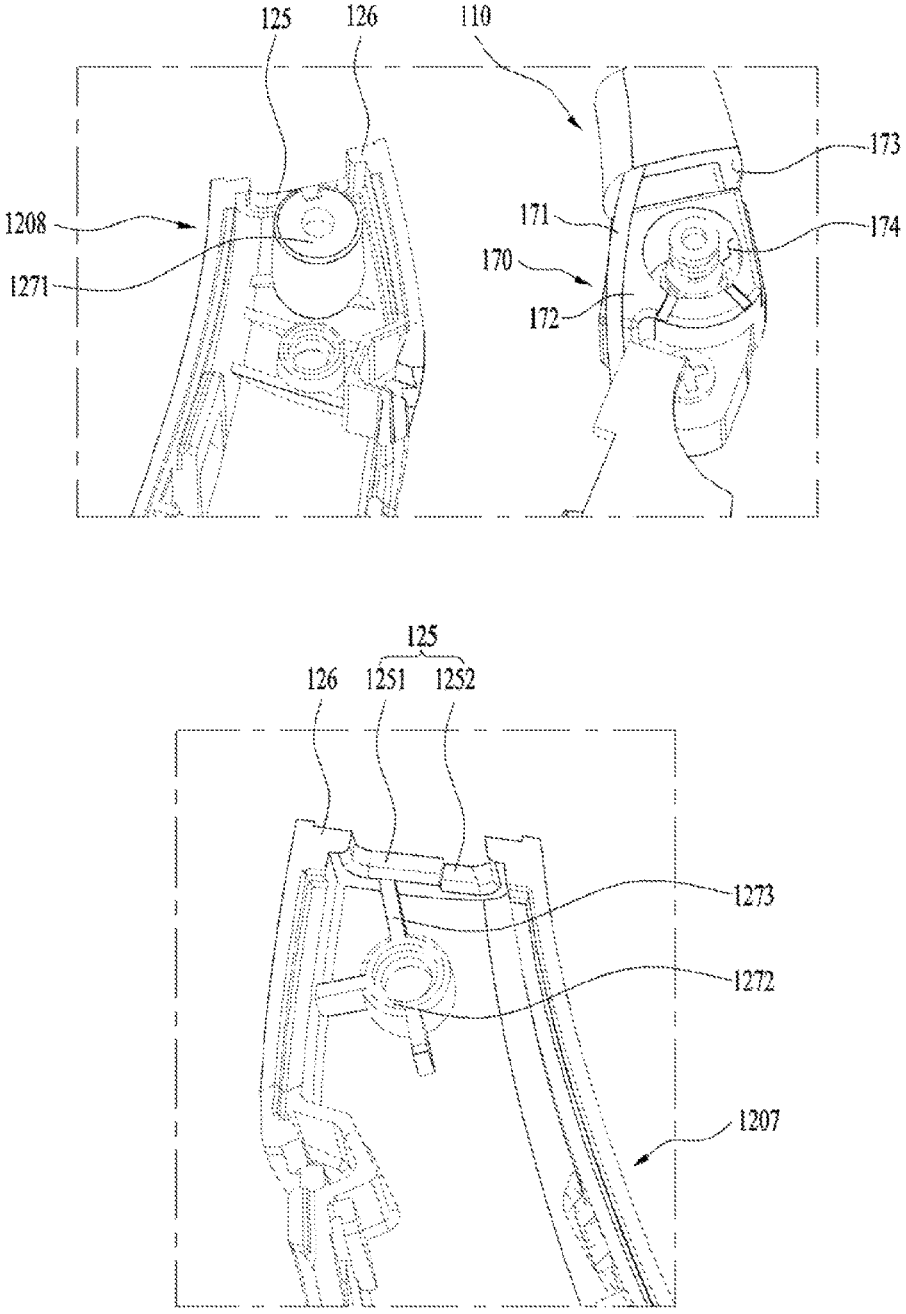
FIG. 10 is a diagram illustrating an upper surface of a neckband wire end and inner surfaces of upper and lower cases.

FIGS. 8 and 9 are exploded perspective diagrams partially illustrating the portable sound equipment 100. FIG. 10 is a diagram illustrating an upper surface of the neckband wire end 170 and inner surfaces of upper and lower cases 1207 and 1208. For easy explanation sake, FIGS. 8 through 10 will be referred to.

A fixing lateral wall 126 provided in one end of the main body 120 forms an insert hole 125 in which an end of the neckband wire 110 is inserted.

The end 170 of the neckband wire 110 includes a fixing bracket 172 and a wire unit 171. The fixing bracket 172 is configured to support the wire unit 171 to maintain the overall shape of the portable sound equipment 100. At the same time, the fixing bracket 172 is seated in the electric control unit 1205 of the main body 120.

The fixing lateral wall 126 may form the insert hole 125 and provided in each of the upper and lower cases 1207 and 1208.

The recess 173 formed in the end 170 of the neckband wire is secured to the fixing lateral wall 216. The recess 173 and an outer surface of the fixing bracket 172 may form a step with respect to an outer surface of the fixing bracket 172 to define some space in which the fixing lateral wall 126 is inserted. The coupling between the recess 173 having the step and the fixing lateral wall 126 may fix the neckband wire 110 and the main body 120 in a longitudinal direction.

Moreover, the fixing lateral wall 126 and the recess 173 are in close contact with each other with respect a perpendicular direction with respect to the longitudinal direction of the neckband wire 110, so as to enhance the coupling force. The coupling structure which is perpendicular to the longitudinal direction may enhance the waterproof effect as well as the coupling force.

A first support portion 1251 is configured to support an upper recess 173 formed in the upper surface of the fixing bracket 172.

In this instance, the wire unit 171 may be projected from the upper surface of the fixing bracket 172. A second support portion 1252 is configured to support the wire unit 171.

More specifically, the first support portion 1251 of the fixing lateral wall 126 supports the recess 173 of the fixing bracket 172 and the second support portion 1252 supports the wire unit 171, to enhance the coupling force and prevent the liquid permeated through the gap generated between the neckband wire 110 and the main body 120 from flowing into the electric control unit of the main body 120.

The wire unit 171 projected to the top of the fixing bracket 172 allows the fixing lateral wall 126 to completely in contact with the recess 173, so that it may be difficult to insert the fixing lateral wall in the recess 173. Accordingly, the structure considering that is required.

That is, the second support portion 1252 forms the step with the first support portion 1251, so as to prevent the fixing lateral wall 126 from interfering with the end of the neckband wire, especially, the wire unit 171.

The upper case 1207 and the lower case 1208 may be fastened to each other by using a screw. The upper case 1207 is coupled to an upper end of the lower case 1208 to form the electric control unit. A first fastening boss 1271 and a second fastening boss 1272 may be used in the screw fastening. Especially, the first fastening boss 1271 is inserted for an outer surface to closely contact with an inner circumferential surface of the seating hole 174 formed in the neckband wire 110 so that the neckband wire 110 may be seated in the lower case 1208 stably.

A rib 1273 provided in an inner surface 1201 of the upper case 1207 is configured to connect the second fastening boss 1272 with the first support portion 1251. As the first support portion 1251 forms a higher wall than the second support portion 1252, the durability might become relatively weak. The rib 1273 is configured to support the first support portion 1251 to compensate for the weakened durability.

Figure 11:
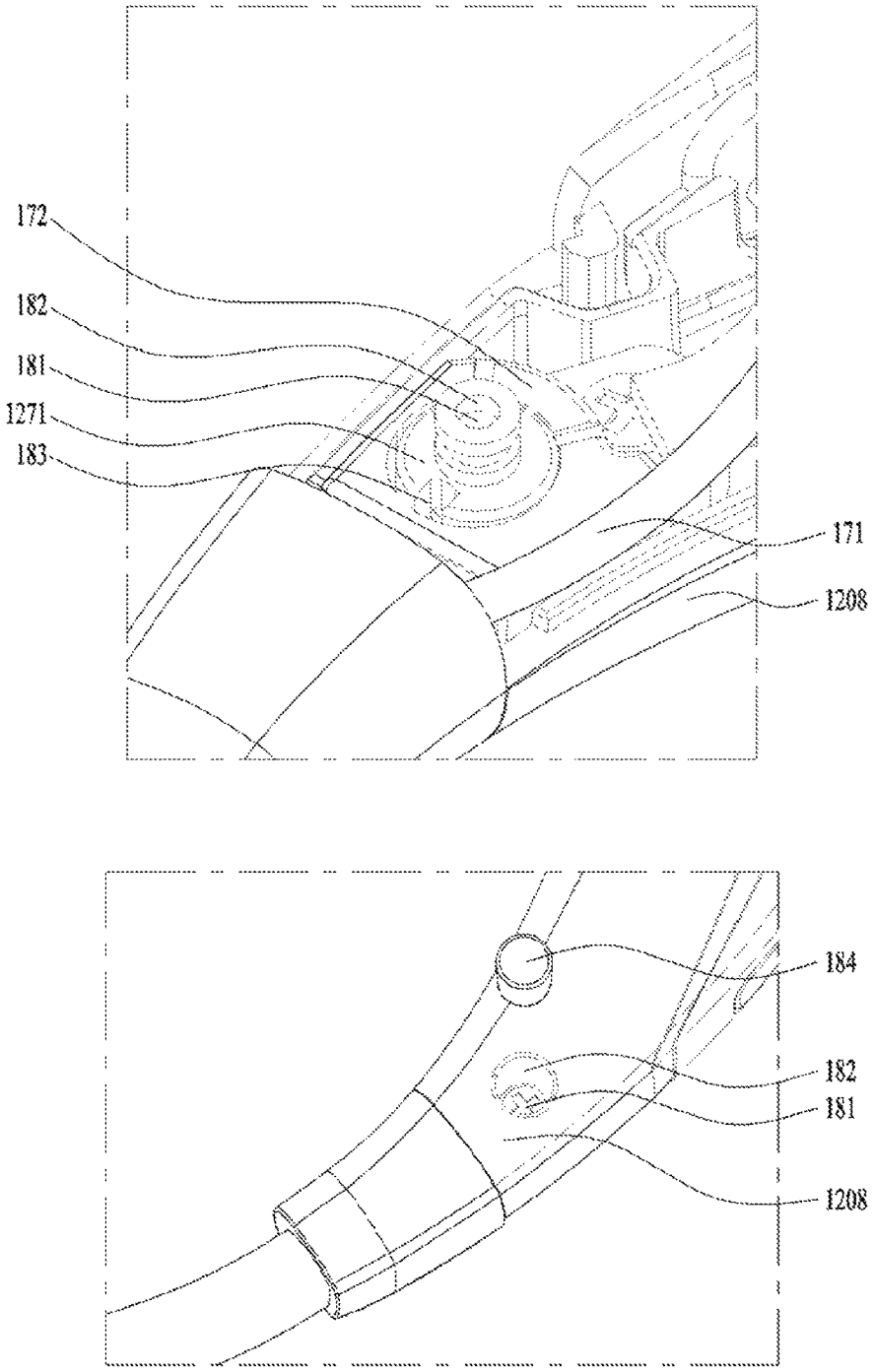
FIG. 11 includes a front partially perspective diagram and a rear perspective diagram illustrating the main body of the portable sound equipment, with the upper case removed therefrom.

FIG. 11 includes a front partially perspective diagram and a rear perspective diagram illustrating the main body 120 of the portable sound equipment 100, with the upper case removed therefrom. For easy explanation sake, FIGS. 10 and 11 will be referred to together.

The first fastening boss 1271 and the second fastening boss 1272 may include a screw hole to which a screw 181 is fastened. The screw hole 182 penetrates the first and second fastening bosses 1271 and 1272.

It is preferred that the screw 181 is fastened in a direction from the first fastening boss 1271 to the second fastening boss 1272, in other words, from the bottom to the top of the portable sound equipment 100. That is because the screw 181 located in the lower surface 1204 of the portable sound equipment 100 is less noticeable.

A hole cap 184 is provided to cover or block a predetermined area of the screw hole 182 exposing the screw 181 there through. When the screw 181 is fastened from the bottom to the top, the hole cap 184 is provided in the lower case 1208.

The hole cap 184 may allow the screw 181 to be invisible, when the main body 120 is viewed from outside.

In case the hole cap 184 covers the predetermined area of the screw hole 182, the space formed between the screw 181 and the hole cap 184 is shut off enough to generate a pressure difference which might cause the easy escape of the hole cap 184. A pressure adjust hole 183 is provided to prevent the escape of the hole cap. The pressure adjust hole 183 is formed through the space formed between the screw 181 and the hole cap 184 and the electric control unit 1205 to prevent the shut off of the space formed between the screw 181 and the hole cap 184.

Figure 12A:
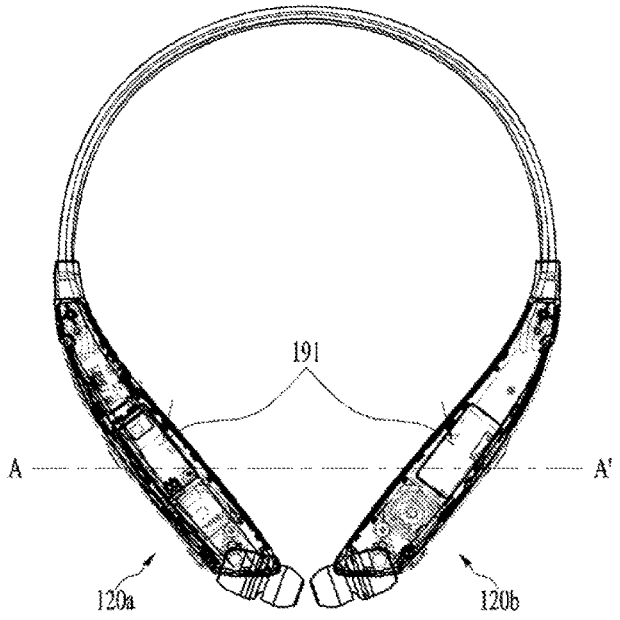
FIG. 12(*a*) is a front view of the portable sound equipment and FIG. 12(*b*) is a sectional diagram of FIG. 12(*a*) along A-A'.
Figure 12B:
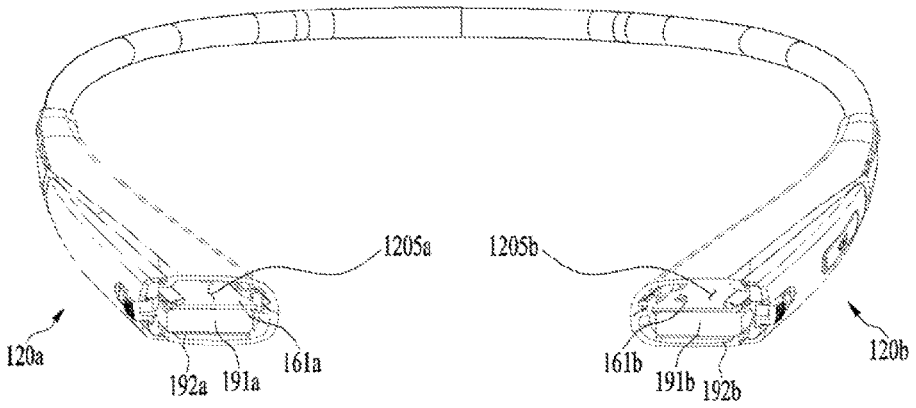

FIG. 12 (*a*) is a front view of the portable sound equipment 100 and FIG. 12 (*b*) is a sectional diagram along A-A' shown in FIG. 12 (*a*).

The main body 120 coupled to both ends of the neckband wire 110 is divided into a first body 120*a* and a second body 120*b*.

The portable sound equipment 100 requires a light weight and slim design so as to not provide much of a load on the user's body and also provide a minimized volume.

The battery 191 may become an important element in determining the weight and volume of the portable sound equipment 100. Accordingly, the capacity arrangement of the battery in the main body might become a problem to solve. Two batteries 191 may be provided in both main bodies 120, respectively. When the batteries 191 are dividedly provided in both main bodies 120, a sufficient battery capacity is provided and space utility is maximized enough to minimize the portable sound equipment.

A first printed circuit board 161*a* may be provided in a first electric control unit 1205*a* formed by the first body 120*a*. A first battery 191*a* is loaded in the first printed circuit board 161. Similarly, a second printed circuit board 161*b* is provided in a second electric control unit 1205*b* formed by the second body 120*b* and a second battery 191*b* is loaded in the second printed circuit board 161*b*.

Each of the main body 120 and the electric control unit 1205 may have a horizontal cross section area with respect to a longitudinal direction of the main body, in other words, a vase shaped cross section area with respect to a cross section area along A-A'. More specifically, the upper width and the lower width may be relatively narrow and the middle width may be the widest.

The printed circuit board 161 may be horizontally arranged in a central portion of the electric control unit 1205 and the electronic components are loaded in an upper surface of the printed circuit board 161. The battery 191 may be loaded in an empty space formed in a lower surface of the printed circuit board 161.

The width of the battery 191 may be provided narrower than that of the printed circuit board, to be suitable to the vase-shaped cross section area.

An adhesive material 192 may be disposed between the battery 191 and the lower surface 1204 of the electric control unit provided in the main body to facilitate the coupling between them. The first battery 191*a* may be bonded by a first adhesive material 192*a* and the second battery 191*b* may be bonded by a second adhesive material 192*b*.

The space of the lower area under the electric control unit provided in each body, not used by the battery 191 may be minimized and the overall thickness may be minimized.

Figure 13:
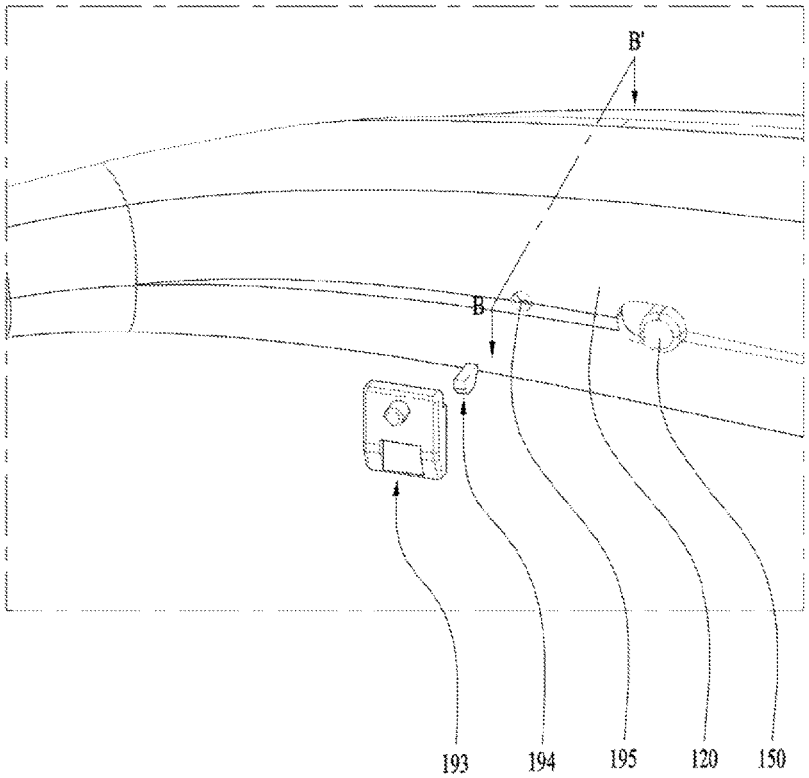
FIG. 13 is an exploded perspective diagram partially illustrating the portable sound equipment.
Figure 14:
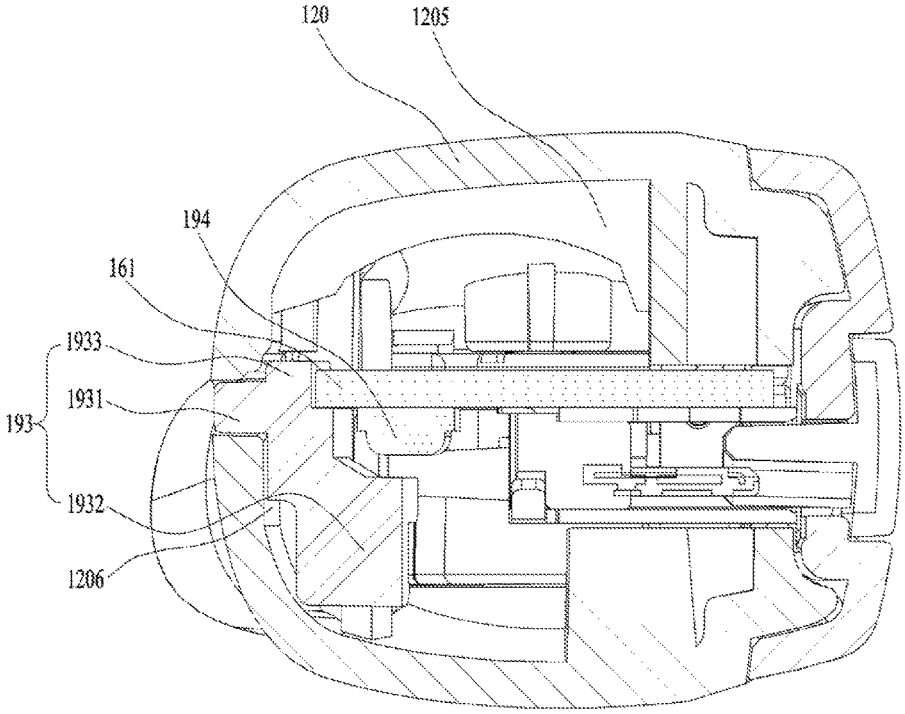
FIG. 14 is a sectional diagram of FIG. 13 along B-B'.

FIG. 13 is an exploded perspective diagram partially illustrating the portable sound equipment 100. FIG. 14 is a sectional diagram of FIG. 13 along B-B'. For easy explanation, FIGS. 13 and 14 will be referred to together.

A light emitting unit 193 is configured to diffuse and guide the light emitted from a light emitting element 194 to be luminescent and visible outside the main body 120. The light emitting unit 193 may function as a state display unit configured to display a specific state of the portable sound equipment 100.

For example, power on or off states of the portable sound equipment 100 may be shown by presence of light emitting or distinguishing of colors. When the second button 150 functions as the power button, the light emitting unit 193 may be provided in a predetermined area adjacent to the second button 150.

The light emitting unit 193 may be located in a further rearward area along the longitudinal direction of the main body 120 with respect to the second button 150.

The light emitting element 194 may be arranged in a rear surface of the printed circuit board 161. The light emitting unit 193 may include a luminescent lens 1931 exposed to the exterior of the main body; and a diffusion portion 1932 provided adjacent to the light emitting element 194 and configured to provide a passage along which light is diffused toward the luminescent lens 1931.

The luminescent lens 1931 may be provided with the same phase with the printed circuit board 161 to realize the slim thickness of the main body 120. In other words, the luminescent lens 1931 may be located in a lateral surface of the printed circuit board 161. In this instance, it is likely that the light emitted by the light emitting element 194 fails to be diffused to the luminescent lens 1931 sufficiently.

An expanded portion 1933 is extended from the diffusion portion 1932 to be located in a lateral surface of the printed circuit board 161. In other words, the diffusion portion 1933 functions as supplement the function of the diffusion portion 1932 so that the light can be diffused to the luminescent lens 1931 sufficiently.

In this instance, one end of the diffusion portion 1933 may support the inner wall 1206 of the electric control unit 1205 provided in the main body 120 and the other end may support the lateral surface of the printed circuit board 161. More specifically, the printed circuit board 161 is configured to push and hold the diffusion portion 1933 so that the light emitting unit 193 including the luminescent lens 1931 may not move in the main body 120.

Although embodiments have been described with reference to a number of illustrative embodiments thereof, it should be understood that numerous other modifications and embodiments can be devised by those skilled in the art that will fall within the spirit and scope of the principles of this disclosure.

More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A portable sound equipment comprising: a neckband configured to be worn around a neck of a user, the neckband having a pair of ends; a main body coupled to the pair of ends of the neckband and configured to provide an electric control unit; a first button hole located in a first area of the main body; a first button exposed through the first button hole; a side case configured to cover the first area of the main body; and a drainage groove provide in the first area along a circumference of the first button hole, the drainage groove providing a step in an outer surface of the main body, wherein the drainage groove includes: an upper groove horizontally extending along an upper area of the first button hole; and a pair of side grooves vertically extending from the upper groove along opposite sides of the first button hole.

2. The portable sound equipment of claim 1, wherein the pair of side grooves are continuously formed with the upper groove.

3. The portable sound equipment of claim 1, wherein the drainage groove includes a collecting groove adjacent the upper groove, the collecting groove having at least a greater depth or a greater width than the upper groove.

4. The portable sound equipment of claim 1, wherein the drainage groove provides a loop around the first button hole.

5. The portable sound equipment of claim 1, further comprising:

a second button hole located in a second area of the main body; and a second button provided in the second button hole, the second button including:

a holding portion exposed through the second button hole;

a hooking portion coupled to one end of the holding portion and supported on an inner wall of the electric control unit; and a sealing portion spaced from the holding portion on the hooking portion, the sealing portion encircling the holding portion and being supported on the inner wall to encircle the second button hole.

6. The portable sound equipment of claim 5, wherein the sealing portion comprises urethane and is formed in the hooking portion by double injection molding.

7. The portable sound equipment of claim 5, wherein the first button is a dome key button and the second button is a slidable button.

* * * * *